US007874049B2

(12) United States Patent
Paik

(10) Patent No.: US 7,874,049 B2
(45) Date of Patent: Jan. 25, 2011

(54) BUCKLE

(75) Inventor: Nam Il Paik, Sungbuk-Ku (KR)

(73) Assignee: Jisook Paik, Seoul (KR)

( * ) Notice: Subject to any disclaimer, the term of this patent is extended or adjusted under 35 U.S.C. 154(b) by 1108 days.

(21) Appl. No.: 11/546,758

(22) Filed: Oct. 12, 2006

(65) Prior Publication Data

US 2007/0079486 A1 Apr. 12, 2007

(30) Foreign Application Priority Data

Oct. 12, 2005 (KR) ..... 20-2005-0029057 U

(51) Int. Cl.
*A44B 11/25* (2006.01)

(52) U.S. Cl. ..... 24/615; 24/614; 24/633; 24/170

(58) Field of Classification Search ..... 24/615, 24/614, 604, 633, 639, 636, 643, 647, 655, 24/656, 179, 178, 191
See application file for complete search history.

(56) References Cited

U.S. PATENT DOCUMENTS 3,600,768 A * 8/1971 Romanzi et al. ..... 24/579.11
4,035,877 A * 7/1977 Brownson et al. ..... 24/323
4,228,567 A * 10/1980 Ikesue et al. ..... 24/642
4,564,983 A * 1/1986 Saito ..... 24/170
4,843,688 A * 7/1989 Ikeda ..... 24/170
4,977,650 A * 12/1990 Ida ..... 24/614
5,113,556 A * 5/1992 Murai et al. ..... 24/633
5,220,713 A * 6/1993 Lane et al. ..... 24/628
5,371,926 A * 12/1994 Van Noy et al. ..... 24/171
5,406,681 A * 4/1995 Olson ..... 24/650
5,709,014 A * 1/1998 Takahashi ..... 24/614
5,855,057 A * 1/1999 Anscher ..... 24/614
6,000,109 A * 12/1999 Anscher ..... 24/614
6,061,883 A * 5/2000 Uehara ..... 24/625
6,170,133 B1 * 1/2001 Uehara ..... 24/614
6,381,810 B2 * 5/2002 Hsieh ..... 24/170
2009/0293243 A1 * 12/2009 Yoshiguchi ..... 24/633

* cited by examiner

*Primary Examiner*—Robert J Sandy
*Assistant Examiner*—Rowland D Do
(74) *Attorney, Agent, or Firm*—Jordan and Hamburg LLP

(57) ABSTRACT

Disclosed is a buckle attached to a belt or a strap which is connected to a rucksack, a bag, clothing, and a helmet, etc. so as to connect the belt or the strap. The buckle includes: a male member including a body and first latching means; and a female member which includes a body and second latching means rotatably coupled to the body so as to latch on the first latching means, for removably engaging with the male member. The buckle constructed as described above has a simple structure. Thus, it is possible to reduce the manufacturing cost of the buckle. Furthermore, there is an advantage in that the second latching means of the female member may be softly pushed, so as to easily release the male member from the female member.

13 Claims, 7 Drawing Sheets

BUCKLE

BACKGROUND OF THE INVENTION

1. Field of the Invention

The present invention relates to a buckle, and more particularly to a buckle which has male and female members respectively attached to a terminal end of each belt or strap for a rucksack, a bag, clothing, and the like, and releasably coupled to each other so as to connect the belts or the straps to each other, while easily adjusting the length of the belt or the strap.

2. Description of the Prior Art

Generally, "buckles" refer to coupling members which have a pair of male and female members attached to an end of a belt or a strap for a rucksack or a bag so as to connect the belt or the strap to another one as described above, which are integrally formed of a synthetic resin material and elastically coupled to each other.

The buckles can be classified into an open type buckle in which a female member has slots, and a non-open type buckle in which a female member has no slot, according to their use, with respect to products such as rucksacks, bags, and clothes, etc. In the open type buckle 300, both engaging legs 312 of a male member 310 are inserted into a chamber 322 of a female member 320 and coupled to slots 324 opened at both sides of the female member 320, as shown in FIG. 1. On the other hand, in order to release the male member 310 from the female member 320, the engaging legs 312 coupled to the slots 324 are pressed, so that the male member 310 is removed from the female member 320.

On the other hand, in the non-open type buckle 200, an engaging portion at a leading end of a male member is inserted into a body of a female member and then coupled to an engaging portion formed in the female member. In order to release the male member from the female member, pressed means formed on an exterior of the female member is pressed, so that the male member is removed from the female member.

Specifically, in the open type buckle, the engaging legs of the male member coupled to the slots 324 of the female member are pressed so that the male member is released from the female member. On the other hand, in the non-open type buckle 200, since the female member has no open slot, a certain portion of the exterior of the female member is pressed so that the male member is removed from the female member, in order to release the male member from the female member.

These buckles classified as described above have different functions respectively, according to their use and user's necessity. Among the non-open type buckles 200, a conventional buckle having the most general shape will be described with reference to accompanying drawings. FIG. 2 is an exploded perspective view of the non-open type buckle 200 according to the conventional art, FIG. 3A is a sectional view of the buckle, taken along a line A-A' in FIG. 2, and FIG. 3B is a sectional view of the buckle, taken along a line B-B' in FIG. 2. This buckle includes the female member 220 and the male member 250 as described above.

As shown in FIGS. 2 to 3B, the female member 220 has the chamber 221 of which a leading end is opened, and a pressing portion 223 formed on an upper plate 222 thereof. The pressing portion 223 has three surfaces separated from the upper plate 222, of which one remaining surface is integrally formed with the upper plate 222 and has a groove 224. A guide element 225 for an engaging legs is formed below the pressing portion 223 at a desired distance from the pressing portion 223, of which leading end has a latching jaw 226 of the female member 220 in order to latch a latching portion 253 of the male member 250.

The male member 250 has engaging legs 251 protruding from a side of a body of the male member 250, of which a leading end 252 has a rotated letter L shape. The lower end of the rotated letter L shaped leading end 252 is engaged with and coupled to the latching jaw 226 of the female member 220. An elastic plate 254 for releasing the male member 250 is formed between the engaging legs 251 of the male member 250, and is located over the guide element 225 of the female member 220 when the male member 250 is coupled to the female member 220.

With the coupling of the conventional non-open type buckle formed as described above, when the pair of engaging legs 251 formed on a side of the male member 250 is inserted into the chamber 221 through the leading end of the female member 220, the latching portion 253 formed at the lower surface of the leading end of the engaging legs 251 in the female member 220 slides along the surface of the guide element 225 of the female member 220 for the latching legs and is inserted into the female member 220, so as to face and engage with the latching jaw 226 formed at the leading end of the guide element 225 of the female member 220.

Then, in order to release the buckle, while the pressing portion 223 which is formed at an upper portion of the female member 220, is pressed, the elastic plate 254 for releasing the male member 250 causes the latching jaw 226 of the female member 220 to become detached from the latching portion 253 of the male member 250, so that the male and female members 250 and 220 can be separated from each other.

However, the non-open type buckle 200 according to the conventional art as described above, has a structure in which latching elements formed on the male and female members respectively, i.e. the latching jaw 226 of the female member 220 an the latching portion 253 of the male member 250 are coupled at a deep inside of the female member 220, thereby making it difficult to couple the engaging legs 251 to the chamber 221 of the female member 220. In addition, the coupling strength thereof may be low, thereby causing an accident. Further, because the pressing portion 223 formed on the upper plate 222 of the female member 220 has the three surfaces separated from the upper plate 222 while the male member 250 is also divided into the engaging legs 251 and the elastic plate 254, the total strength of the buckle is extremely low, which may cause the buckle to be easily damaged or broken while it is used for long time.

Further, in the non-open type buckle 200 described above, when a user presses the pressing portion 223 of the female member 220, the elastic plate 254 of the male member 250 located below the pressing portion 223 secondarily presses the elastic plate 254 of the female member 250 so as to release the respective members. As described above, since the buckle 200 has the complicated structure, it is difficult to couple and released the male member to and from the female member, and it is possible that the manufacturing cost of the buckle increases.

SUMMARY OF THE INVENTION

Accordingly, the present invention has been made to solve the above-mentioned problems occurring in the prior art, and an object of the present invention is to provide a buckle which includes male and female members having a simple structure, thereby making it possible to reduce the manufacturing cost of the buckle.

Another object of the present invention is to provide a buckle in which an elastic member is provided to the female member so that the male member is rigidly coupled to and easily released from the female member using the elastic force of the elastic member.

Still another object of the present invention is to provide a buckle having a beautiful appearance.

Still another object of the present invention is to provide a buckle which has a reduced space between the male and female members, thereby preventing foreign substance from being introduced into the reduced space.

In order to accomplish the object of the present invention, there is provided a buckle which comprises: a male member including a body and first latching means; and a female member which includes a body and second latching means rotatably coupled to the body so as to latch on the first latching means, for removably engaging with the male member.

The first latching means includes a guide plate which extends at a predetermined distance from the body of the male member and has at least one engaging leg formed on the guide plate. The guide plate is integrated with the body of the male member so as to extend between the sidewalls forming the body of the male member at the other end of the sidewalls. A reinforcing rib formed on a lower surface of the guide plate so as to provide rigidity to the guide plate and receive a part of the female member.

The body of the male member includes two sidewalls, a first traverse bar extending between the sidewalls at an intermediate portion of the sidewalls, and a second traverse bar extending between the sidewalls at one end of the sidewalls.

The guide plate extends at a predetermined distance from the other end of the body of the male member, and has first step portions engaging with step portions formed in the body of the female member respectively and second step portions engaging with step portions formed at one end of sidewalls of a latching plate.

The engaging legs have a generally triangular section, each of which has an engaging face engaging with a latching wall of the latching plate and an incline surface for lifting the latching wall during an insertion of the male member into the female member.

The engaging legs are spaced a desired distance from the first traverse bar of the body of the male member so that the latching wall is located between the body of the male member and the engaging legs when the male member is coupled to the female member.

The second latching means includes a latching plate which receives the first latching means of the male member along with the body of the female member, and a latching wall formed at one end of the latching plate on a lower surface of the latching plate so as to engage with the engaging legs of the first latching means.

The body of the female member includes a bottom plate for guiding and receiving the guide plate of the male member, sidewalls integrated with the bottom plate at side edges of the bottom plate respectively, and a belt connection bar spaced a desired distance from a rear portion of the bottom plate so as to extend between the sidewalls.

The bottom plate has a lip portion formed at a front end of the bottom plate and engages with the reinforcing rib of the male member when the male member is coupled to the female member.

The bottom plate further includes an elastic member for elastically supporting the latching plate pivotally coupled to the body of the female member.

The elastic member is an oblong plate, which may be formed by cutting a part of the bottom plate by a desired length so as to extend to a rear end of the bottom plate, or formed integrally with the bottom plate using a injection molding method when the female member is injection-molded.

The sidewalls have both ends extending a desired distance from a front end and the rear end of the bottom plate so as to form extension portions which have a leading end identical with a terminal end of the lip portion formed at the front end of the bottom plate, respectively. The extension portions of the sidewalls have the step portions which are formed in the extension portions so as to engage with the first step portions of the guide plate when the male member is coupled to the female member.

Each sidewall has a hinge guide groove for guiding a hinge of the latching plate and a hinge hole in which the hinge of the latching plate is rotatably inserted, all of which are formed at an intermediate portion on an inner surface of each sidewall. The hinge guide groove is slantingly formed from an upper end of each sidewall to the hinge hole and has a width corresponding to a diameter of the hinge hole.

The latching plate is a flat plate, which has a length equal to that of the bottom plate of the body including the lip portion and a width equal to or less than that between the sidewalls of the body. Further, the latching plate has sidewalls formed at both side edges of the latching plate and a latching wall extending downward at a predetermined distance. On the other hand, a groove is formed on an inner surface of the latching plate, in order to receive a free end of the elastic member.

The sidewalls of the latching plate have hinges extending outward by a desired distance from an intermediate portion of the sidewalls, and the step portions at a position spaced a desired distance from the front end of the sidewalls, respectively. The step portions of the latching plate come into contact with the second step portions formed on the guide plate of the male member, respectively, when the male member is inserted into the female member.

In the buckle according to the present invention as described above, it is possible to reduce the manufacturing cost of the buckle since the male and female members have a simple structure. Further, the male member can be rigidly coupled to the female member by the elastic force of the elastic member. Furthermore, the latching plate of the female member is softly pushed, thereby easily releasing the male member from the female member. In addition, there exists only a very small gap between the male and female members, so as to make it possible to prevent foreign substance from being introduced into the space during the coupling of the male and female members.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings.

Figure 4:
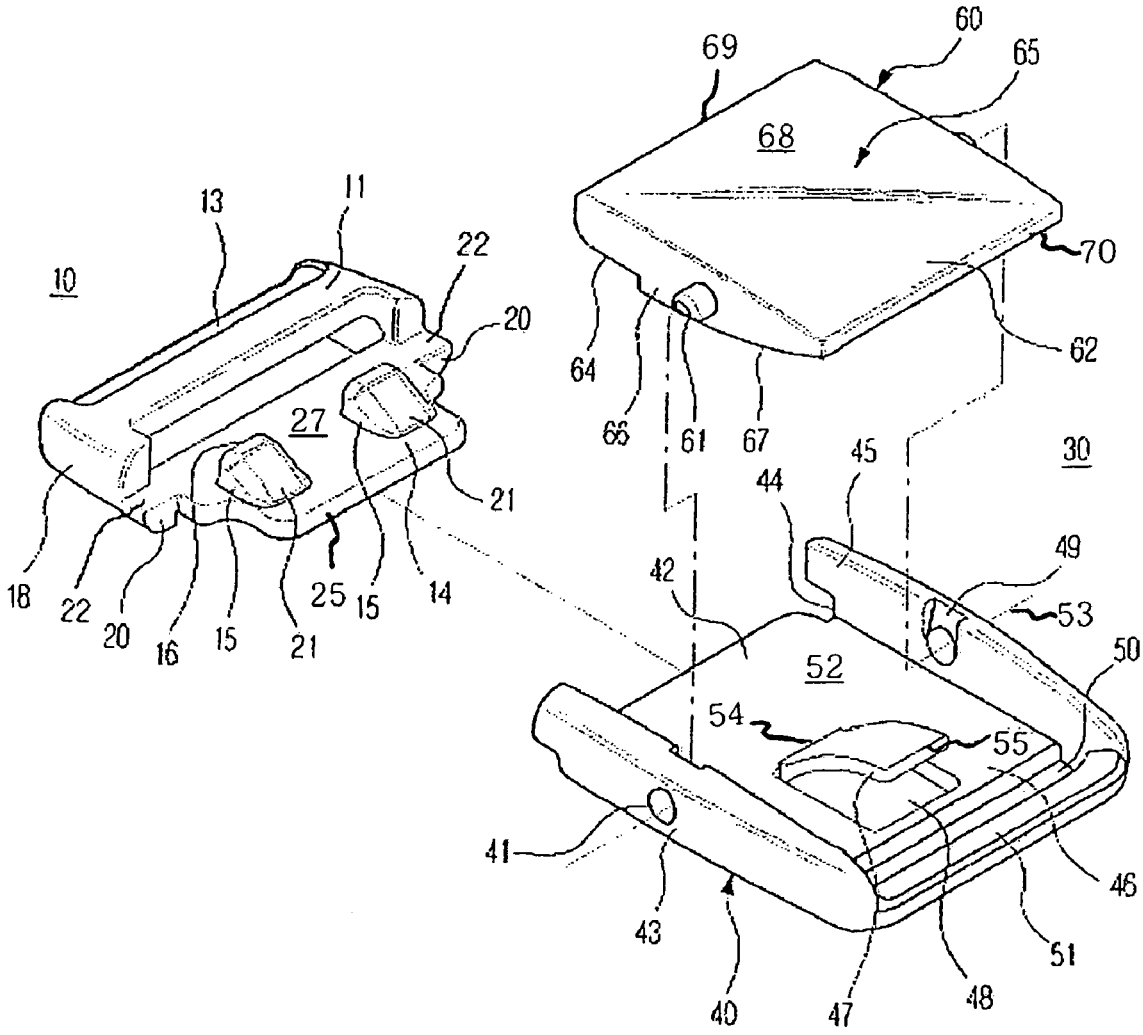
FIG. 4 is an exploded perspective view showing a buckle according to an embodiment of the present invention.
Figure 5:
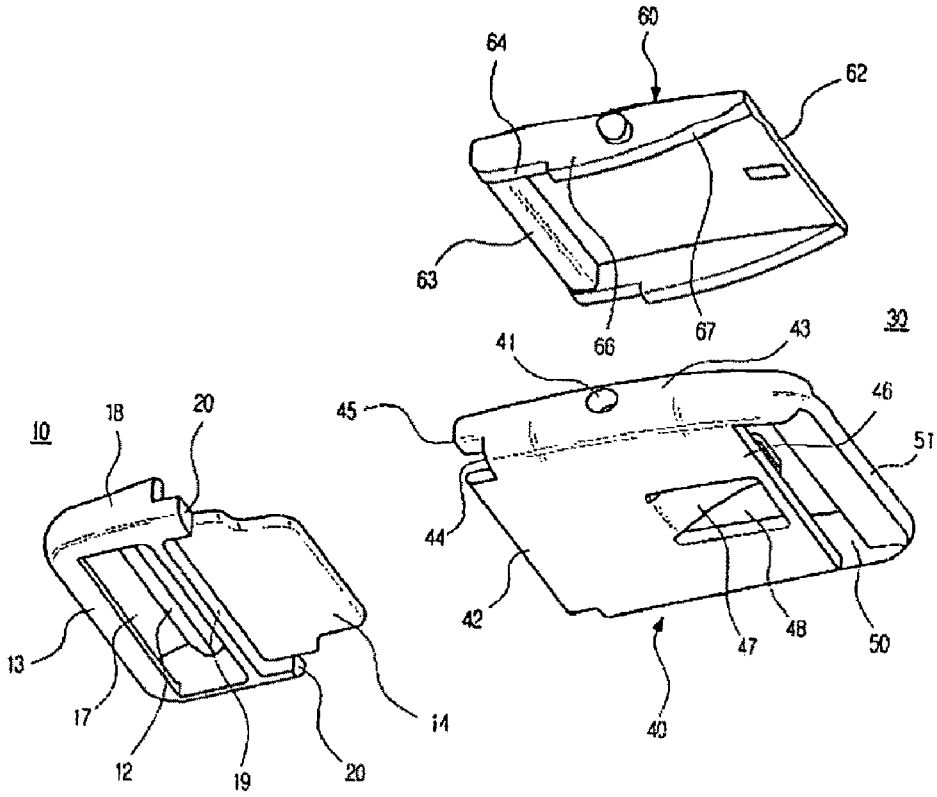
FIG. 5 is an exploded perspective view showing the buckle according to the embodiment of the present invention, which is viewed from another direction.
Figure 6:
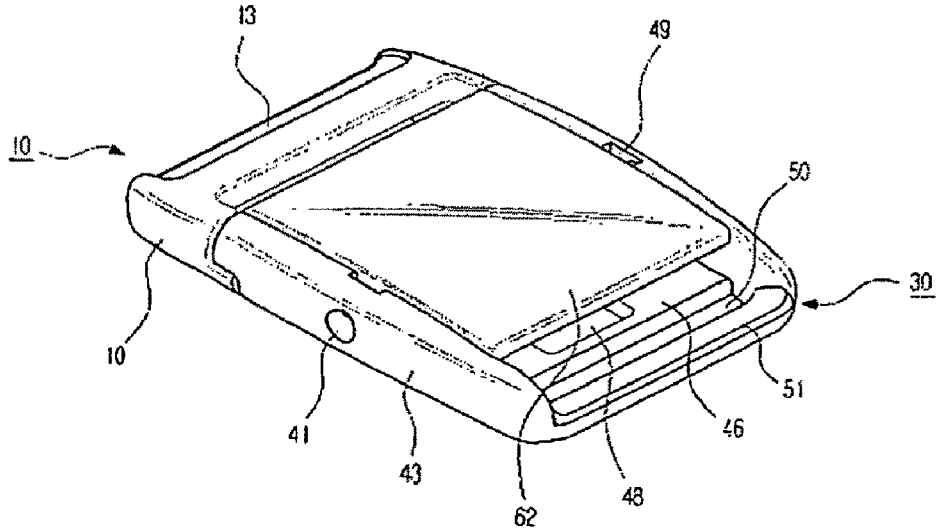
FIG. 6 is a perspective view showing the buckle according to the embodiment of the present invention, in which male and female members are assembled.
Figure 7:
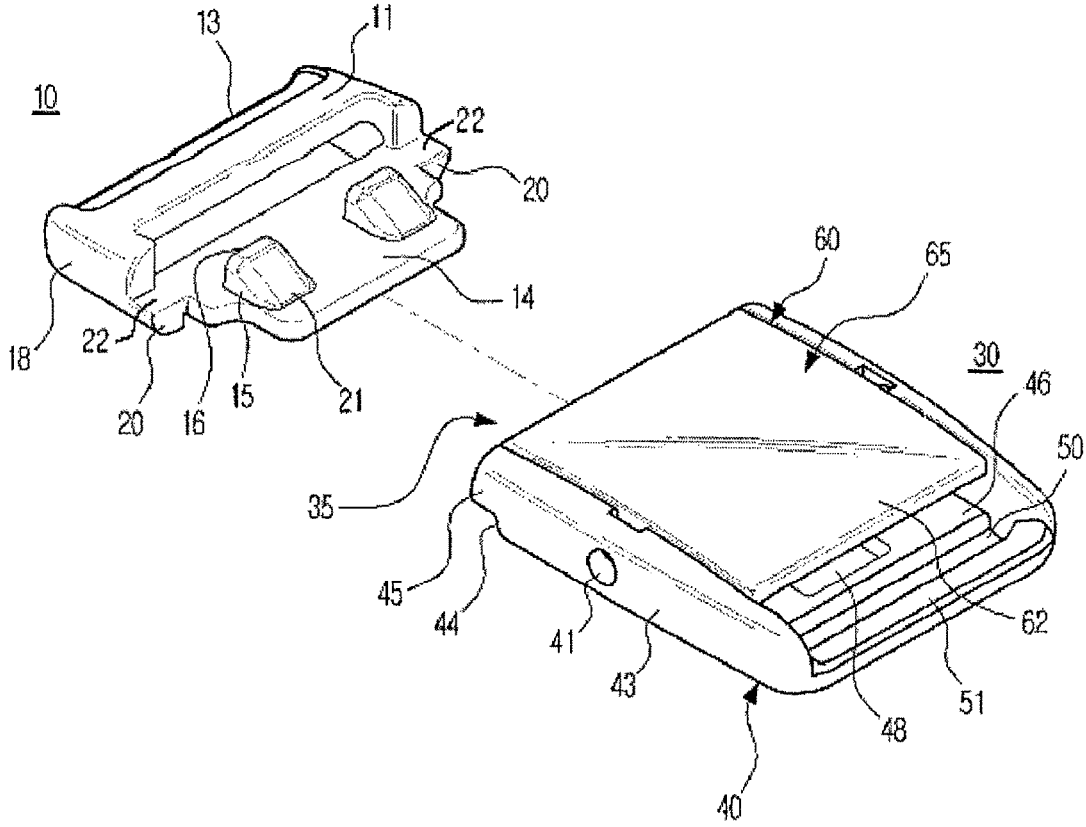
FIG. 7 is a perspective view showing the buckle according to the embodiment of the present invention, in which the male and female members are separated.
Figure 8:
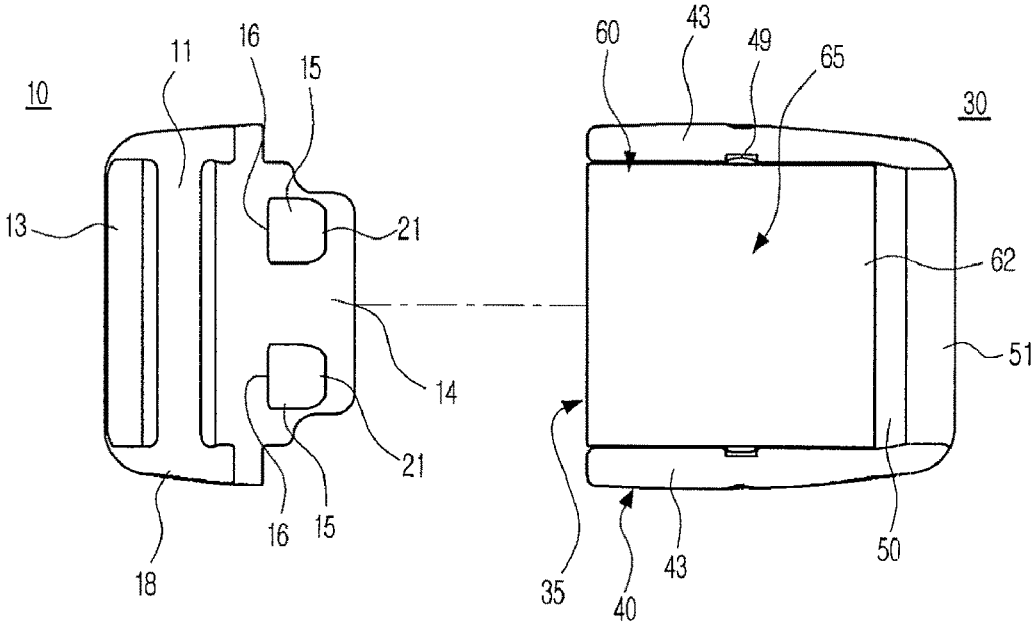
FIG. 8 is a plan view of the buckle shown in FIG. 7.
Figure 9:
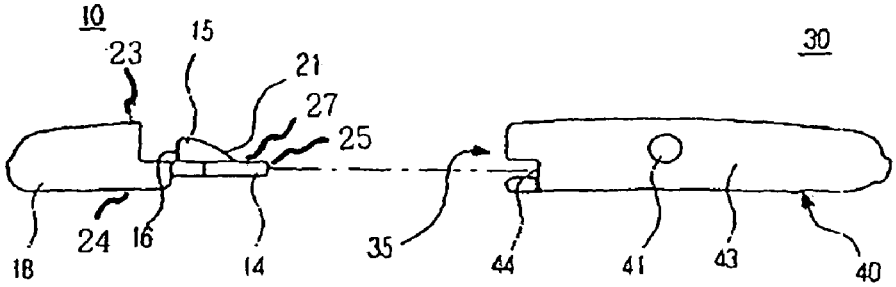
FIG. 9 is a side view of the buckle shown in FIG. 7.
Figure 10:
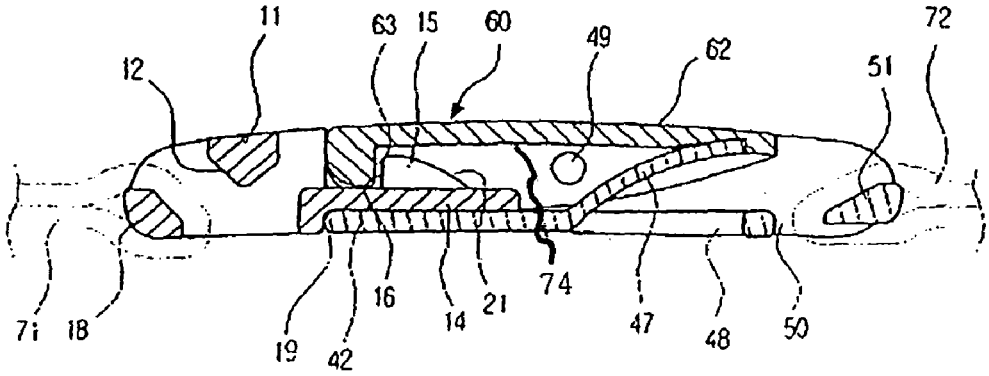
FIG. 10 is a side view of the buckle shown in FIG. 6.

FIG. 4 is an exploded perspective view showing a buckle according to an embodiment of the present invention, FIG. 5 is an exploded perspective view showing the buckle according to the embodiment of the present invention, which is viewed from another direction, FIG. 6 is a perspective view showing the buckle according to the embodiment of the present invention, in which male and female members are assembled, FIG. 7 is a perspective view showing the buckle according to the embodiment of the present invention, in which the male and female members are separated, FIG. 8 is a plan view of the buckle shown in FIG. 7, FIG. 9 is a side view of the buckle shown in FIG. 7, and FIG. 10 is a side view of the buckle shown in FIG. 6.

Referring to FIGS. 4 to 10, the buckle according to the present invention includes male and female members 10 and 30 which are separably assembled with each other. The male and female members 10 and 30 are generally made of synthetic resin material, each of which is connected to a free end of belts 71 and 72, or straps.

The male member 10 includes a body 11 and a first latching member 14. The body 11 has a height extending from an undersurface 24 to an uppersurface 23 at opposing sidewalls 18. The first latching member 14 is a guide plate 14 which extends a predetermined distance from the body 11 to a leading end 25 and has at least one engaging leg 15 formed on an upper surface thereof.

The body 11 of the male member 10 includes two sidewalls 18, a first traverse bar 12 extending between the sidewalls 18 at an intermediate portion of the sidewalls 18, and a second traverse bar 13 extending between the sidewalls 18 at one end of the sidewalls 18. The free ends of the belts are connected to the first and second traverse bar 12 and 13 extending between the sidewalls 18, respectively, so that a user can adjust the length of the belts. Further, the first and second traverse bars 12 and 13 have a triangular cross-section or a trapezoidal cross-section.

Meanwhile, the guide plate 14 is integrated with the body 11 of the male member 10 so as to extend between the other ends of the sidewalls 18 forming the body 11 of the male member 10. A reinforcing rib 19 is formed on a lower surface of the guide plate 14 so as to provide rigidity to the guide plate 14 and receive a lip portion 42 of the female member 30 described below.

The guide plate 14 extends a predetermined distance from the other end of the body 11 of the male member 10, which has first step portions 20 engaging with step portions 44 formed in the body 40 of the female member 30 respectively and second step portions 22 engaging with step portions formed at one end of sidewalls 66 of a latching plate 60.

The guide plate 14 has at least one engaging leg 15 on an upper surface 27 thereof, which is integrated with the guide plate 14. The engaging legs 15 have a generally triangular section, each of which has an engaging face 16 engaging with a latching wall 63 of the latching plate 60 and an incline surface 21 for lifting the latching wall 63 during insertion of the male member 10 into the female member 30.

The engaging legs 15 are spaced a desired distance from the first traverse bar 12 of the body 11 of the male member 10 so that the latching wall 63 is located between the body 11 of the male member 10 and the engaging legs 15 when the male member 10 is coupled to the female member 30.

On the other hand, the male member 10 has a belt receiving space 17 defined by the sidewalls 18 forming the body 11, the first traverse bar 12, the second traverse bar 13, and the reinforcing rib 19 supporting the guide plate 14. The belt receiving space 17 can stably received the belt 71 when the belt 71 is connected to the male member 10.

The female member 30 includes the body 40 and second latching member rotatably coupled to the body 40. The second latching member has the latching plate 60 for receiving the first latching member 14 of the male member 10, i.e. the guide plate 14, along with the body 40, and the latching wall 63 which is formed at one end on a lower surface of the latching plate 60 so as to engage with the engaging legs 15 of the first latching member 14.

The body 40 of the female member 30 includes a bottom plate 46 for guiding and receiving the guide plate 14 of the male member 10, sidewalls 43 integrated with the bottom plate 46 at side edges of the bottom plate 46 respectively, and a belt connection bar 51 spaced a desired distance from a rear portion of the bottom plate 46 so as to extend between the sidewalls 43.

The bottom plate 46 has a lip portion 42 formed at a front end thereof, as described above. The lip portion 42 engages with the reinforcing rib 17 of the male member 10 when the male member 10 is coupled to the female member 30.

The bottom plate 46 may include an elastic member 47 for elastically supporting the latching plate 60 pivotally coupled to the body 40 of the female member 30. The elastic member 47 is an oblong plate having a proximal end 54 and a distal end 55, which is formed by cutting a part of the bottom plate 46 by a desired length so as to extend to a rear end of the bottom plate 46, or integrated with the bottom plate 46 in a manner of injection molding when the female member 30 is injection-molded.

The sidewalls 43 have both ends extending a desired distance from a front end and the rear end of the bottom plate so as to form extension portions that have a leading end which is identical with a terminal end of the lip portion 42 formed at the front end of the bottom plate 46, respectively. Further, the extension portions 45 of the sidewalls 43 have the step portions 44 formed therein, as shown in FIGS. 4, 5, 6, 7 and 9, so as to engage with the first step portions 20 of the guide plate 14 when the male member 10 is coupled to the female member 30.

Figure 1:
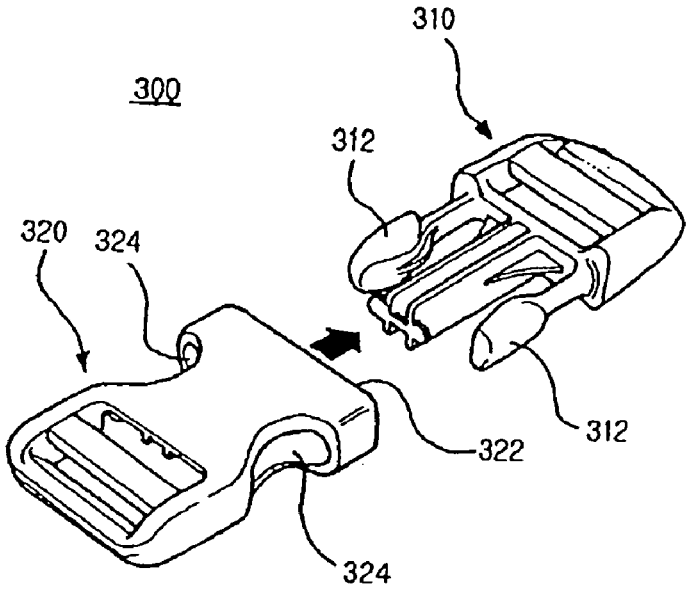
FIG. 1 (Prior Art)
FIG. 1 is a perspective view showing an open type buckle according to the conventional art.
Figure 2:
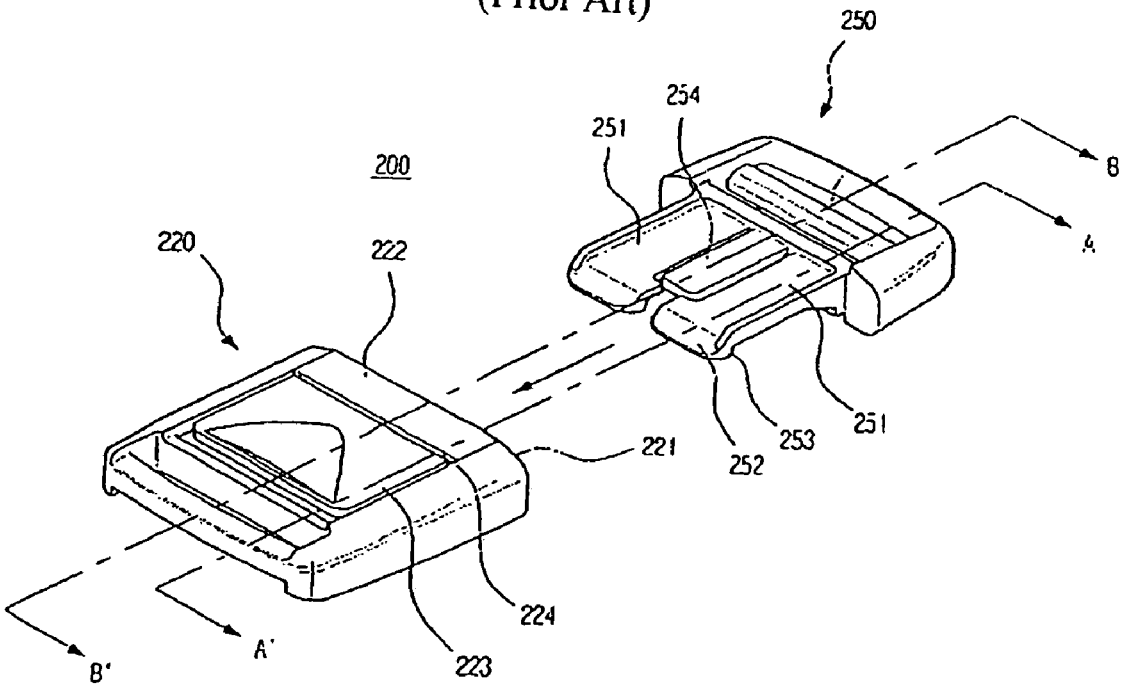
FIG. 2 (Prior Art)
FIG. 2 is an exploded perspective view showing a non-open type buckle according to the conventional art.
Figure 3A:
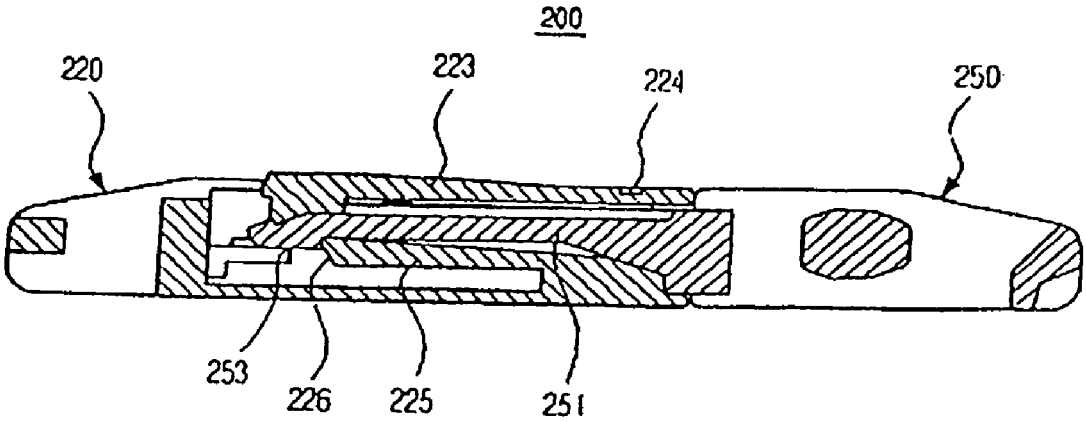
FIG. 3A (Prior Art)
FIG. 3*a* is a sectional view showing the non-open type buckle according to the conventional art, taken along a line A-A', in which male and female members are assembled.
Figure 3B:
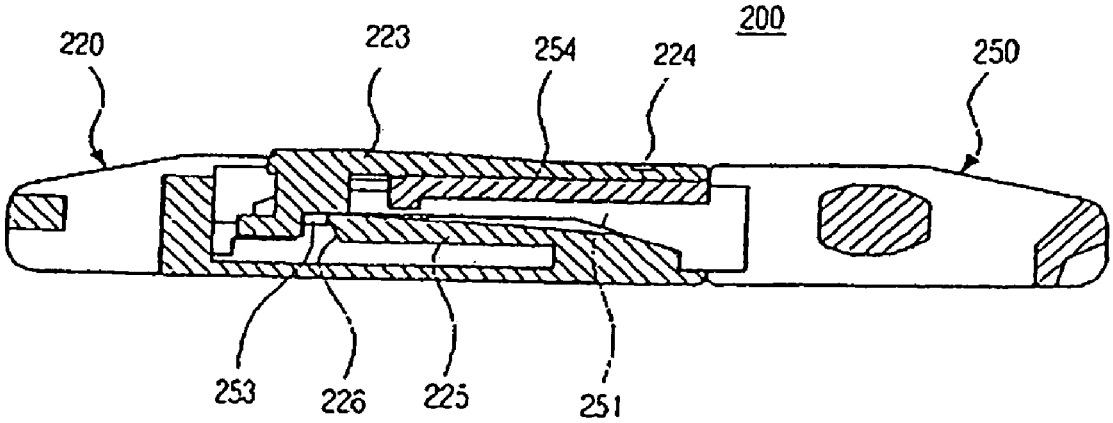
FIG. 3B (Prior Art)
FIG. 3*b* is a sectional view showing the non-open type buckle according to the conventional art, taken along a line B-B', in which the male and female members are assembled.

Further, each sidewall 43 has a hinge guide groove 49 for guiding a hinge 61 of the latching plate 60 and a hinge hole 41 as a pivot in which the hinge 61 of the latching plate 60 is rotatably inserted, which are formed at an intermediate portion on an inner surface of each sidewall 43, as shown in FIG. 3. The hinge guide groove 49 is slantingly formed from an upper end of each sidewall 43 to the hinge hole 41 and has a width corresponding to the diameter of the hinge hole 41.

The latching plate 60 is a flat plate, which has an uppersurface 68, an undersurface 74, a front end 69 and an opposite rear end 70, a length equal to that of the bottom plate 46 of the body 40 including the lip portion 40, and a width equal to or less than that between the sidewalls 43 of the body 40. The latching plate 60 has sidewalls 66 formed at both side edges thereof. Further, the latching plate 60 has a latching wall 63 extending downward a predetermined distance from the front end 69 thereof.

The sidewalls 66 of the latching plate 60 have hinges 61 as respective pivots extending outward at a desired distance from an intermediate portion of the sidewalls 66, and the step portions 64 at a position spaced at a distance from the front end of the sidewalls 66, respectively. The step portions 64 of the latching plate 60 come into contact with the second step portions 22 formed in the guide plate 14 of the male member 10, respectively, when the male member 10 is inserted into the female member 30.

Figure 11:
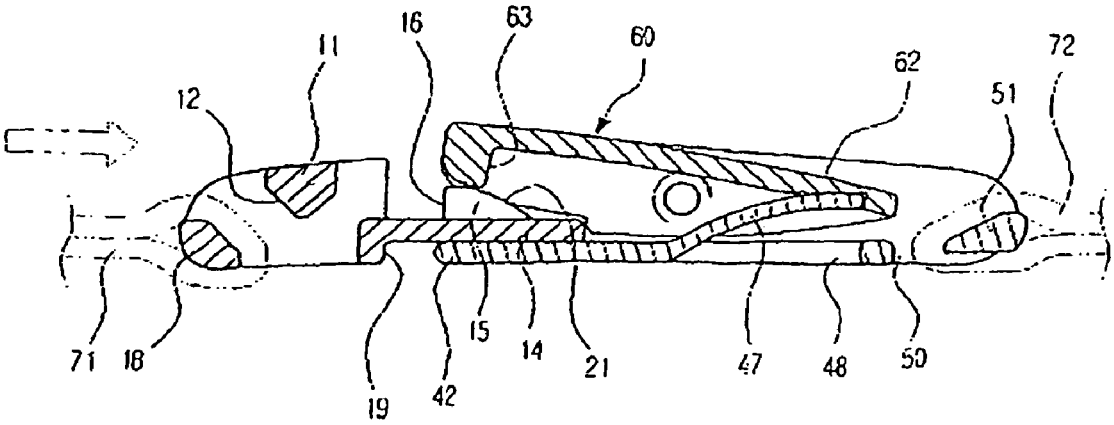
FIG. 11 is a sectional view showing the buckle according to the embodiment of the present invention, in which an operation of the female member is shown when the male member is assembled with the female member.
Figure 12:
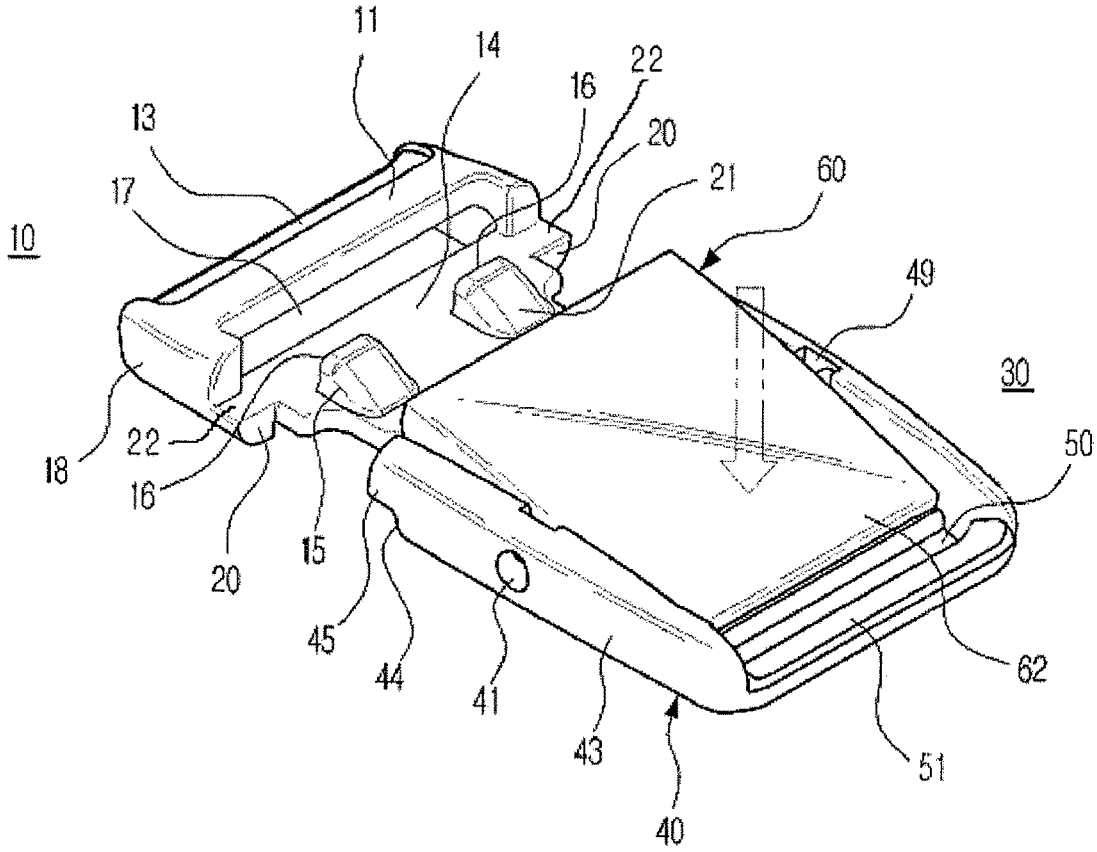
FIG. 12 is a perspective view showing the buckle according to the embodiment of the present invention, in which an operation of the female member is shown when the male member is released from the female member.
Figure 13:
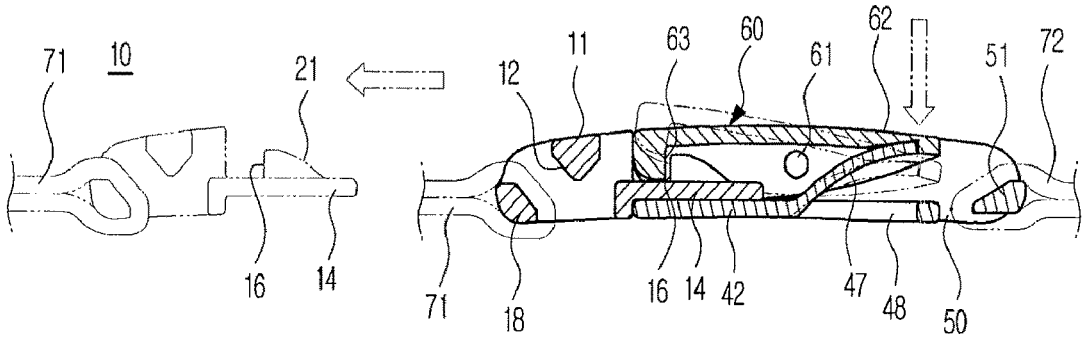
FIG. 13 is a sectional view showing the buckle according to the embodiment of the present invention, in which an operation of the female member is shown when the male member is released from the female member.

Meanwhile, each sidewall 66 has an inclined surface 67 formed to have a smooth curvature from an intermediate portion to the rear end 70 thereof. Thus, when the rear end 70 of the latching plate 60 is pressed in order to release the male member 10 from the female member 30, the latching plate 60 rotates clockwise, as shown in FIG. 11 about pivot axis 53. At this time, the inclined surface 67 of each sidewall 66 having acurvature causes the latching plate 60 to rotate smoothly.

The latching wall 63 formed at the front end of the latching plate 60 has a thickness identical with or less than a distance between the other end of the body 11 and the engaging legs 15 of the male member 10. Further, the latching wall 63 has an inner surface perpendicular to the latching plate 60 so that the inner surface rigidly engages with the engaging faces 16 of the engaging legs 15.

On the other hand, the latching plate 60 has a groove formed on an inner surface thereof, in order to receive a free end of the elastic member 47. Therefore, the latching plate 60 is urged by elastic force of the elastic member 47 so that the front end of the latching plate 60 is pressed downwardly while the rear end of the latching plate 60 is pressed upwardly. At this time, the latching plate 60 is supported by one end of the sidewalls 66 thereof against the bottom plate 46 of the body 40, so as to become horizontal.

Hereinafter, the operation of the buckle according to the preferred embodiment of the present invention will be described in detail with reference to the accompanying drawings.

First, the male member 10 is made using the injection molding method, so that the guide plate 14 is integrated with the body 11 of the male member 10. On the other hand, relating to the female member 30, the bottom plate 46, the sidewalls 43 and the elastic member 47 are integrally injection-molded so as to make the body 40 of the female member 30. Alternatively, after the bottom plate 46 and the sidewalls 43 are injection-molded, a part of the bottom plate 46 is cut in order to form the elastic member 47, thereby making the body 40 of the female member 30. On the other hand, the latching plate 60 of the female member 30 is also made using the injection molding method.

Next, the hinges 61 of the latching plate 60 are located at an entrance of the hinge guiding grooves 49 formed in an inner surface of the sidewalls 43 of the body 40. Then, the latching plate 60 is pressed so that the hinges 61 move downward along the hinge guiding grooves 49 and are inserted into the hinge holes formed on the sidewalls of the body 40, respectively. Thus, the latching plate 60 is assembled with the body 40 of the female member 30 so as to rotate clockwise and counterclockwise about the hinge 61.

The male and female members 10 and 30 made and assembled as described above are connected to both ends of the strap or the belt, respectively, or to the straps respectively. First, the male member 10 is connected to one end of the strap or the belt in such a manner that a terminal end of the strap or one end of the belt extends through a gap between the first traverse bar 12 and the guide plate 14 from the belt receiving space 17 of the male member 10, is wound on the first traverse bar 12, and finally extends through a gap between the first traverse bar 12 and the second traverse bar 13.

As the terminal end of the strap or the one end of the belt is connected to the male member 10 as described above, a user can suitably adjust the length of the strap or the belt connected to the male member 10. Further, when the user couples the male member 10 to the female member 30 after adjusting the length of the strap or the belt, the second traverse bar 13 of the male member 10 makes the terminal end of the strap or the one end of the belt come into contact with another portion of the strap or belt, thereby preventing an involuntary change of the length of the strap or the belt.

On the other hand, the female member 30 is connected to a terminal end of another strap or the other end of the belt. Specifically, the terminal end of another strap or the other end of the belt extends at a desired distance through a gap between the bottom plate 46 of the body 40 and the belt connection bar 51 so as to be wound on the belt connection bar 51. Then, the terminal end of another strap or the other end of the belt is made to be in close contact with another portion of another strap or another portion of the belt and the facing straps or belts are sewn, so that the female member 30 is fixedly connected to the terminal end of another strap or the other end of the belt.

When the male and female members 10 and 30, which are connected to the different straps or both ends of the belt respectively as described above, are coupled to each other, the length of the connected strap or belt can be suitably adjusted.

Meanwhile, in order to couple the male member 10 to the female member 30, the leading end of the guide plate 14 of the male member 10 is located at an opening of the chamber 35 defined by the body 40 of the female member 30 and the latching plate 60. Next, the body 11 of the male member 10 is pushed and inserted into the chamber 35 defined in the female member 30.

At this time, the guide plate 14 of the male member 10 slides along an uppersurface 52 of the bottom plate 46 of the female member 30, while the engaging legs 15 formed on the upper surface 27 of the guide plate 14 slowly lifts the latching wall 63 formed on the latching plate 60 of the female member 30. When the guide plate 14 continuously slides along the bottom plate 46 so that the reinforcing rib 19 of the male member 10 faces the lip portion 42 of the bottom plate 46, the latching plate 60 is simultaneously rotated counterclockwise by the elastic force of the elastic member 47, so that the latching wall 63 of the latching plate 60 engages with the engaging legs 15. Since the latching wall 63 engages with the engaging legs 15 as described above, the male member 10 is rigidly coupled to the female member 30.

However, the male member 10 may be coupled to the female member 30 in a manner different from that described above. Specifically, the leading end of the guide plate 14 of the male member 10 is located at the opening of the chamber 35 defined by the body 40 of the female member 30 and the latching plate 60. Then, after the rear end of the latching plate 60 of the female member 30 is pushed downward in order to rotate the latching plate 60 clockwise, so as to expand the opening of the chamber 35 defined in the female member 30, the guide plate 14 of the male member 10 is pushed and inserted into the chamber 35 of the female 30. Next, the latching plate 60 is rotated counterclockwise by using the elastic force of the elastic member 47, so that the latching wall 63 of the latching plate 60 engages with the engaging legs 15 of the guide plate 14. Thus, the male member 10 can be coupled to the female member 30.

On the other hand, in order to release the coupling of the male and female members 10 and 30 which are coupled to each other, the rear end of the latching plate 60 is pushed downward and rotated clockwise around the hinge 61. As a result, the engagement of the latching wall 63 of the latching plate 60 and the engaging legs 15 of the guide plate 14 is released. Then, the guide plate 14 of the male member 10 is removed from the chamber 35 of the female member 30, thereby releasing the coupling of the male and female members 10 and 30.

In the buckle according to the present invention as described above, it is possible to reduce the manufacturing cost of the buckle since the male and female members have a simple structure. Further, while the male member is couple to the female member, the inner structure of the female member has a lower resistance.

On the other hand, in the buckle according to the present invention, since the elastic member is provided to the female member, the male member can be rigidly coupled to the female member by using the elastic force of the elastic member. Furthermore, in the state that the male member is coupled to the female member, the latching plate of the female member is softly pushed, thereby easily releasing the male member from the female member.

Furthermore, the buckle according to the present invention has a beautiful appearance, and also has only a very small gap between the male and female members, thereby preventing foreign substance from being introduced into the female member during the coupling of the male and female members.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A buckle comprising a male member, a latching member, and a first body, the latching member being pivotally coupled to the first body to define a female assembly for receiving the male member, wherein the male member comprises in one molded structure: a second body, a guide plate, and an engaging leg, the second body having a height extending from an undersurface to an uppersurface at opposing side walls, the guide plate extending from the second body and having a leading end furthest from said second body, the guide plate having an undersurface elevated relative to the second body undersurface and having an uppersurface recessed relative to said second body uppersurface, the engaging leg having an engaging face extending from the guide plate upper surface to a leg height and having an incline surface inclining from said leg height back to said guide plate upper surface toward the guide plate leading edge;

wherein the latching member comprises in one molded structure: an upper plate, a first and a second sidewall, a latching wall, a first pivot, and a second pivot, the upper plate having an uppersurface defining an upper outer surface of the female assembly, the upper plate having a length from a first end to an opposite second end, the latching wall located at an upper plate undersurface toward the first end, the first and second sidewalls located at opposite side edges of the upper plate and having a height exceeding a thickness of the upper plate, the first pivot located along the first sidewall, the second pivot located along the second sidewall, the latching wall being configured to engage with the engaging leg;

wherein the first body comprises in one molded structure: a bottom plate, third and fourth sidewalls, an elastic member, a third pivot and a fourth pivot, the bottom plate configured to guide and receive the guide plate of the male member at an upper surface of the bottom plate, the third and fourth sidewalls located at opposite side edges of the bottom plate and having a height exceeding a thickness of the bottom plate, the third pivot located along the third sidewall, the fourth pivot located along the fourth sidewall, the first and third pivots mating and the second and fourth pivots mating to define a pivot axis about which the latching member is pivotally coupled to the first body, the pivot axis occurring at an intermediate portion of the first, second, third and fourth sidewalls which, relative to the length of the upper plate, is offset from both the first end and second end of the upper plate, the elastic member having a proximal end at an upper surface of the bottom plate and extending to a distal end contacting the upper plate along the length of the upper plate at a location between the pivot axis and the second end; and wherein when the male member is buckled to the female assembly, the elastic member supports the upper plate toward the second end to maintain the latching member pivoted with the latching wall engaged to the engaging leg, and wherein when force is applied downward at the upper plate second end the latching member pivots about the pivot axis pushing the elastic member distal end downward toward the bottom plate upper surface and elevating the latching wall relative to the engaging leg.

2. The buckle as claimed in claim 1, wherein the second body includes a first traverse bar extending between the opposing sidewalls at an intermediate portion of the opposing sidewalls, and a second traverse bar extending between the opposing sidewalls at one end of the opposing sidewalls, the first and second traverse bars forming a part of a belt receiving space in which a belt is received when the belt is connected to the male member.

3. The buckle as claimed in claim 1, wherein a reinforcing rib is formed on a lower surface of the guide plate to provide rigidity to the guide plate and receive a part of the female assembly.

4. The buckle as claimed in claim 1, wherein the guide plate extends a predetermined distance from an end of the second body and has first step portions engaging with step portions formed in the first body respectively and second step portions engaging with step portions formed at respective first ends of the first and second sidewalls of the latching member.

5. The buckle as claimed in claim 1, wherein the engaging leg has a generally triangular section.

6. The buckle as claimed in claim 1, wherein the first body further includes a belt connection bar spaced a desired distance from a rear portion of the bottom plate to extend between the first and second sidewalls thereof.

7. The buckle as claimed in claim 1, wherein the engaging leg is spaced a desired distance from the first traverse bar of the second body so that the latching wall is located between the second body and the engaging leg when the male member is coupled to the female assembly.

8. The buckle as claimed in claim 3, wherein the bottom plate has a lip portion located at a front end of the bottom plate and engages with the reinforcing rib of the male member when the male member is coupled to the female assembly.

9. The buckle as claimed in claim 8, wherein the third and fourth sidewalls of the second body have front ends extending a desired distance from the front end of the bottom plate to form extension portions which have a leading end identical with a terminal end of the lip portion formed at the front end of the bottom plate.

10. The buckle as claimed in claim 9, wherein the extension portions of the third and fourth sidewalls of the first body have step portions which are formed in the extension portions to engage with the first step portions of the guide plate when the male member is coupled to the female assembly.

11. The buckle as claimed in claim 10, wherein the first and second sidewalls of the latching member have the step portions at a position spaced a desired distance from the front end of the first and second sidewalls of the latching member, respectively.

12. The buckle as claimed in claim 11, wherein the step portions of the latching member upper plate come into contact with the second step portions formed on the guide plate of the male member, respectively, when the male member is inserted into the female assembly.

13. The buckle as claimed in claim 12, wherein the latching member upper plate has a groove formed on the undersurface thereof, in order to receive the distal end of the elastic member.

* * * * *